US007843474B2

(12) United States Patent
Lee et al.

(10) Patent No.: US 7,843,474 B2
(45) Date of Patent: Nov. 30, 2010

(54) DRIVING APPARATUS FOR LIQUID CRYSTAL DISPLAY

(75) Inventors: Jae Woo Lee, Kyoungsengbuk-do (KR); Gun Woo Do, Daegu (KR)

(73) Assignee: LG Display Co., Ltd., Seoul (KR)

( * ) Notice: Subject to any disclaimer, the term of this patent is extended or adjusted under 35 U.S.C. 154(b) by 646 days.

(21) Appl. No.: 10/963,605

(22) Filed: Oct. 14, 2004

(65) Prior Publication Data

US 2005/0140629 A1 Jun. 30, 2005

(30) Foreign Application Priority Data

Dec. 16, 2003 (KR) ..... 10-2003-0091785
Apr. 16, 2004 (KR) ..... 10-2004-0026374

(51) Int. Cl.
*G09G 5/10* (2006.01)

(52) U.S. Cl. ..... 345/690; 345/204; 345/87; 345/89

(58) Field of Classification Search ..... 345/204, 345/690, 55, 63, 84, 87–89, 98–99
See application file for complete search history.

(56) References Cited

U.S. PATENT DOCUMENTS 5,161,220 A * 11/1992 Watanabe ..... 358/1.16
6,025,822 A * 2/2000 Motegi et al. ..... 345/98
6,363,505 B1 * 3/2002 Vest et al. ..... 714/726
6,873,312 B2 * 3/2005 Matsueda ..... 345/98
7,176,867 B2 * 2/2007 Lee ..... 345/89
7,423,618 B2 * 9/2008 Song ..... 345/87
7,495,648 B2 * 2/2009 Kang et al. ..... 345/100
2002/0149556 A1 * 10/2002 Matsueda ..... 345/98
2002/0175886 A1 * 11/2002 Ham ..... 345/87
2005/0128169 A1 * 6/2005 Kang et al. ..... 345/87

FOREIGN PATENT DOCUMENTS

KR 10-2001-0004879 1/2001

OTHER PUBLICATIONS

IBM Technical Disclosure Bulletin (NN9507311), "Enhanced 16-Bit Direct Color for Natural Images," Jul. 1995, vol. 38, Issue 7, p. 311-320.*
Machine Translation of KR-1020010004879A.*

* cited by examiner

*Primary Examiner*—Alexander Eisen
*Assistant Examiner*—Jason M Mandeville
(74) *Attorney, Agent, or Firm*—McKenna Long & Aldridge LLP

(57) ABSTRACT

A driving apparatus for a display wherein an m-bit data driver integrated circuit is used to drive n-bit data. The apparatus includes a timing controller arranged to supply n-bit data, and a plurality of m-bit data integrated circuits having a predetermined value for two least significant bits, wherein the m-bit data driver integrated circuits output the n-bit data from the timing controller as video signals having $2^n$ gray levels.

10 Claims, 10 Drawing Sheets

FIG.6A

| GRAY LEVEL | B7' | B6' | B5' | B4' | B3' | B2' | B1' | B0' |
|---|---|---|---|---|---|---|---|---|
| 0 | 0 | 0 | 0 | 0 | 0 | 0 | 0 | 0 |
| 1 | 0 | 0 | 0 | 0 | 0 | 1 | 0 | 0 |
| 2 | 0 | 0 | 0 | 0 | 1 | 0 | 0 | 0 |
| 3 | 0 | 0 | 0 | 0 | 1 | 1 | 0 | 0 |
| 4 | 0 | 0 | 0 | 1 | 0 | 0 | 0 | 0 |
| ⋮ | | | | ⋮ | | | | ⋮ |
| 62 | 1 | 1 | 1 | 1 | 1 | 0 | 0 | 0 |
| 63 | 1 | 1 | 1 | 1 | 1 | 1 | 1 | 1 |

FIG.6B

| GRAY LEVEL | B7' | B6' | B5' | B4' | B3' | B2' | B1' | B0' |
|---|---|---|---|---|---|---|---|---|
| 0 | 0 | 0 | 0 | 0 | 0 | 0 | 0 | 0 |
| 1 | 0 | 0 | 0 | 0 | 0 | 1 | 1 | 1 |
| 2 | 0 | 0 | 0 | 0 | 1 | 0 | 1 | 1 |
| 3 | 0 | 0 | 0 | 0 | 1 | 1 | 1 | 1 |
| 4 | 0 | 0 | 0 | 1 | 0 | 0 | 1 | 1 |
| ⋮ | | | | ⋮ | | | | ⋮ |
| 62 | 1 | 1 | 1 | 1 | 1 | 0 | 1 | 1 |
| 63 | 1 | 1 | 1 | 1 | 1 | 1 | 1 | 1 |

DRIVING APPARATUS FOR LIQUID CRYSTAL DISPLAY

This application claims the benefit of Korean Patent Application No. P2003-91785 filed on Dec. 16, 2003, and Korean Application No. P2004-26374 filed on Apr. 16, 2004, which are hereby incorporated by reference for all purposes as if fully set forth herein.

BACKGROUND OF THE INVENTION

1. Field of the Invention

The present invention relates to a liquid crystal display. More particularly, the present invention relates to a driving apparatus for a liquid crystal display in which an 8-bit data driver integrated circuit is used to drive 6-bit data.

2. Discussion of the Related Art

A liquid crystal display (LCD) controls light transmittance of liquid crystal cells in accordance with video signals to display a picture. A LCD of an active matrix type provided with a switching device for each liquid crystal cell is suitable for displaying a moving picture. The switching device used for the active matrix type LCD mainly employs a thin film transistor (TFT).

FIG. 1 shows a related art LCD driving apparatus.

In FIG. 1, the related art LCD driving apparatus includes a liquid crystal display panel 2 having m×n liquid crystal cells Clc arranged in a matrix, m data lines D1 to Dm and n gate lines G1 to Gn crossing each other and thin film transistors TFT provided at the crossing of the data and gate lines, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, and a timing controller 10 for controlling the data driver 4 and the gate driver 6.

The liquid crystal display panel 2 includes a plurality of liquid crystal cells Clc arranged, in a matrix, at the crossings of the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line to maintain a voltage of the liquid crystal cell Clc.

The gamma voltage supplier 8 applies a plurality of gamma voltages to the data driver 4 so that analog data signals can be generated.

The timing controller 10 generates a gate control signal GCS and a data control signal DCS using synchronizing signals (or a complex synchronizing signal) supplied from a system (not shown). Herein, the gate control signal GCS is comprised of a gate start pulse GSP, a gate shift clock GSC and a gate output enable signal GOE, etc. The data control signal DCS is comprised of a source start pulse SSP, a source shift clock SSC, a source output enable signal SOE and a polarity signal POL, etc. The timing controller 10 re-aligns the data R, G and B input thereto to apply them to the data driver 4.

The gate driver 6 sequentially applies a scanning signal (or a gate high voltage) to the gate lines G1 to Gn in response to the gate control signal GCS from the timing controller 10. Thus, the thin film transistors TFT connected to the gate lines G1 to Gn are sequentially driven.

The data driver 4 applies pixel signals for each line to the data lines D1 to Dm every horizontal period in response to the data control signal DCS from the timing controller 10. Particularly, the data driver 4 converts digital data R, G and B input from the timing controller 8 into analog pixel signals using gamma voltages from the gamma voltage supplier 8 to apply them to the data lines D1 to Dm.

More specifically, the data driver 4 shifts a source start pulse SSP in response to a source shift clock SSC to generate sampling signals. Then, the data driver 4 sequentially receives the data R, G and B for each certain unit in response to the sampling signals to latch them. Further, the data driver 4 converts the latched data R, G and B for one line into analog data signals to apply the data signals to the data lines D1 to Dm in an enable interval of the source output enable signal SOE. Herein, the data driver 4 converts the data signals into positive signals or negative signals in response to a polarity control signal POL.

In the LCD, the timing controller 10 applies data having various bits to the data driver 4. For example, the timing controller 10 may apply 6-bit data to the data driver 4 as shown in FIG. 2A. Then, the data driver 4 converts the 6-bit data to video signals having 64 gray levels to apply the video signals to the data lines D. Presently, most notebook personal computers display a picture using 6-bit data as shown in FIG. 2A. Herein, the notebook personal computer is driven in a normally white-mode.

On the other hand, the timing controller 10 may apply 8-bit data to the data driver 4 as shown in FIG. 2B. Then, the data driver 4 converts the 8-bit data to video signals having 256 gray levels to apply the video signals to the data lines D. In the related art, computer monitors and televisions display a desired picture using 8-bit data as shown in FIG. 2B, are driven in a normally black mode.

The data driver 4 includes a 6-bit or 8-bit data driver integrated circuit that corresponds with the bit number of data supplied from the timing controller. Specifically, the related art LCD has a problem in that exclusive data driver integrated circuits are mounted to correspond to the bit number of data supplied from the timing controller 10 which leads to compatibility problems with the integrated circuit. Further, when a notebook personal computer is driven in a normally black mode, it is necessary to develop a new 6-bit only integrated circuit.

SUMMARY OF THE INVENTION

Accordingly, the present invention is directed to a driving apparatus for a liquid crystal display that substantially obviates one or more of the problems due to limitations and disadvantages of the related art.

An advantage of the present invention is to provide an 8-bit data driver integrated circuit for use in making a 6-bit and 8-bit compatible data drive.

To achieve this and other advantages and in accordance with the present invention as embodied and broadly described, a driving apparatus for a display includes a timing controller arranged to supply n-bit data; and a plurality of m-bit data integrated circuits having a predetermined value for two least significant bits, wherein the m-bit integrated circuits output the n-bit data from the timing controller as video signals having $2^n$ gray levels.

In another embodiment of the present invention, a method of driving a display includes supplying a control signal to a plurality of m-bit data integrated circuits, wherein the control signal includes n-bit digital data, converting the digital data to analog pixel signals, and generating video signals having $2^n$ gray levels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 6A and FIG. 6B illustrate operation examples of the driving apparatus shown in FIG. 5.

DETAILED DESCRIPTION OF THE ILLUSTRATED EMBODIMENTS

Reference will now be made in detail to embodiments of the present invention, examples of which are illustrated in the accompanying drawings.

Figure 1:
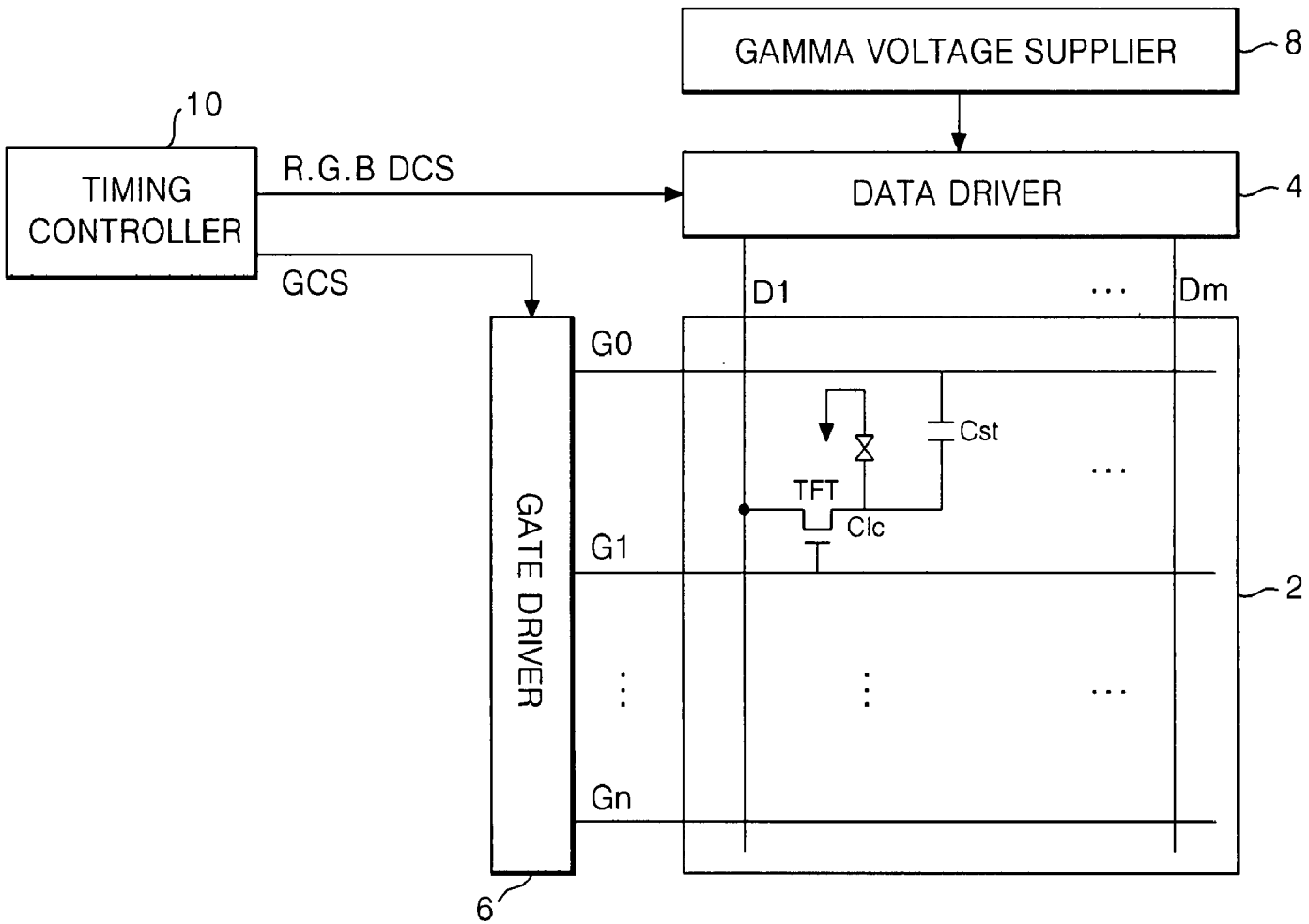
FIG. 1 RELATED ART
FIG. 1 is a block diagram showing a configuration of a related art liquid crystal display.
Figure 2A:
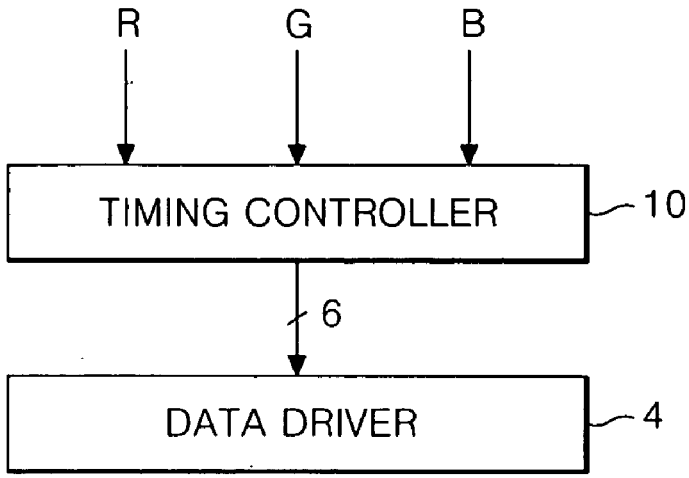
FIG.2A RELATED ART
FIG. 2A illustrates a process in which 6-bit data is transferred from a timing controller.
Figure 2B:
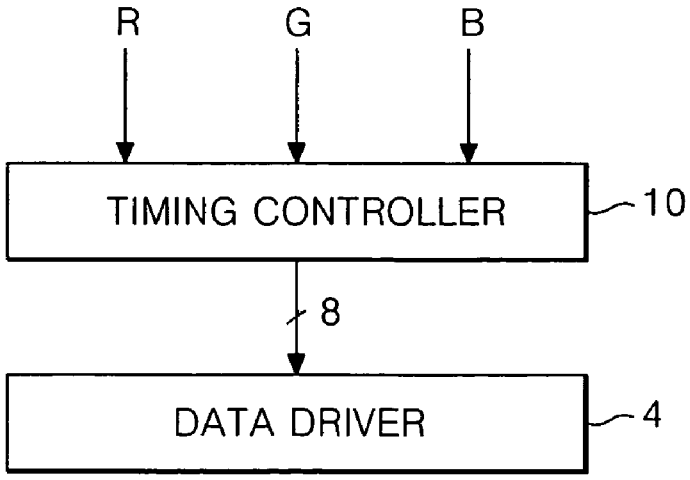
FIG.2B RELATED ART
FIG. 2B illustrates a process in which 8-bit data is transferred from a timing controller.
Figure 3:
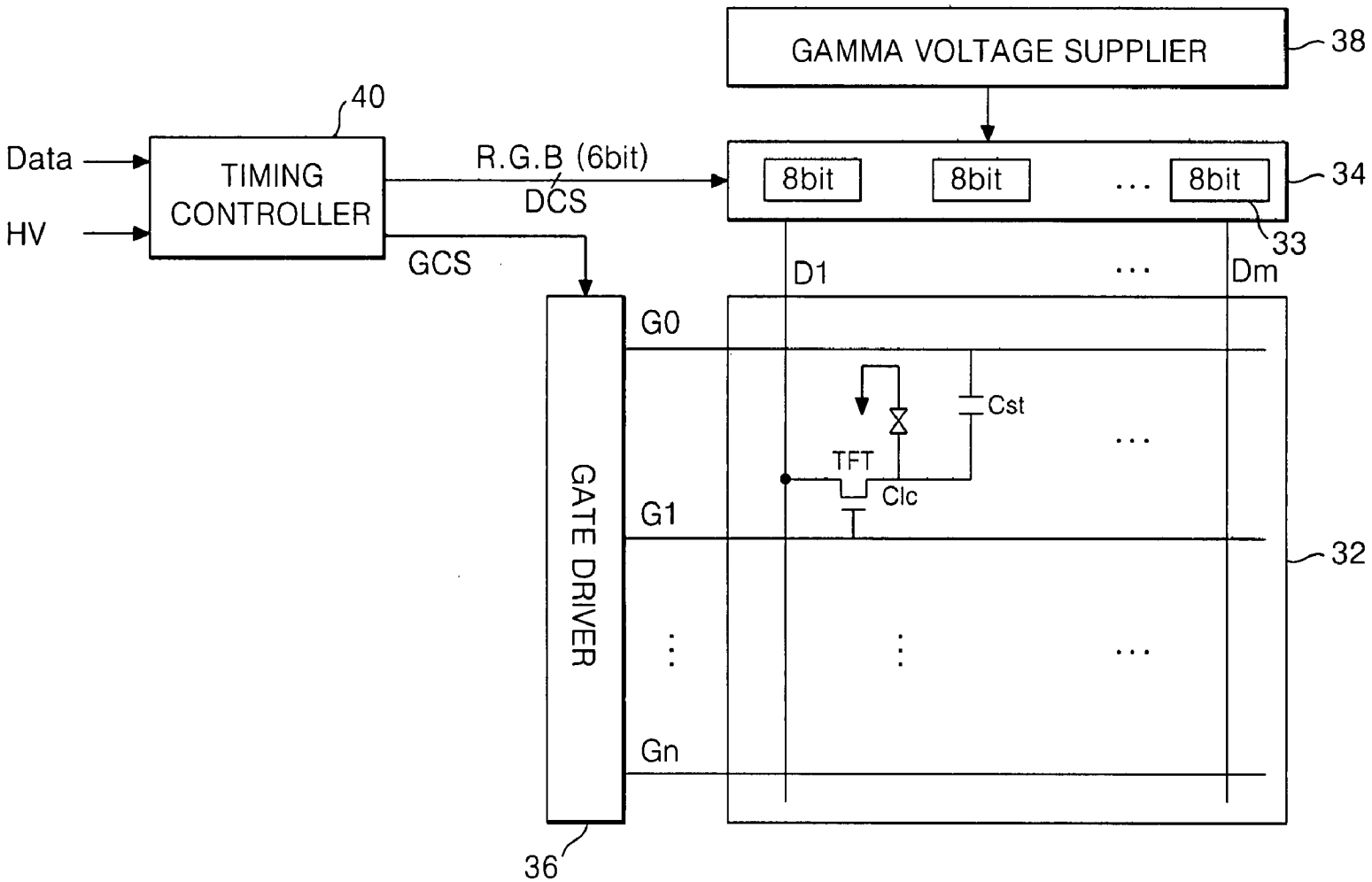
FIG. 3 is a block diagram showing a configuration of a driving apparatus for a liquid crystal display according to an embodiment of the present invention.

FIG. 3 shows a driving apparatus for a liquid crystal display (LCD) according to a first embodiment of the present invention.

In FIG. 3, the driving apparatus for the LCD includes a liquid crystal display panel 32 having m×n liquid crystal cells Clc arranged in a matrix, m data lines D1 to Dm and n gate lines G1 to Gn crossing each other and thin film transistors TFT provided at the crossings, a data driver 34 for applying data signals to the data lines D1 to Dm of the liquid crystal display panel 32, a gate driver 36 for applying scanning signals to the gate lines G1 to Gn, a gamma voltage supplier 38 for supplying the data driver 34 with gamma voltages, and a timing controller 40 for controlling the data driver 34 and the gate driver 36.

The liquid crystal display panel 32 includes a plurality of liquid crystal cells Clc arranged, in a matrix, at the crossings of the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line to maintain a voltage of the liquid crystal cell Clc.

The gamma voltage supplier 38 applies a plurality of gamma voltages to the data driver 34 so that analog data signals can be generated.

The timing controller 40 generates a gate control signal GCS and a data control signal DCS using synchronizing signals (or a complex synchronizing signal) supplied from a system (not shown). Herein, the gate control signal GCS may include a gate start pulse GSP, a gate shift clock GSC and a gate output enable signal GOE, etc. The data control signal DCS may include of a source start pulse SSP, a source shift clock SSC, a source output enable signal SOE and a polarity signal POL, etc. The timing controller 40 re-aligns 6-bit data R, G and B input thereto and applies the data to the data driver 34.

The gate driver 36 sequentially applies a scanning signal (or a gate high voltage) to the gate lines G1 to Gn in response to a gate control signal GCS from the timing controller 40. Thus, the thin film transistors TFT connected to the gate lines G1 to Gn are sequentially driven.

The data driver 34 applies pixel signals for each line to the data lines D1 to Dm every horizontal period in response to data control signal DCS from the timing controller 40. Specifically, the data driver 34 converts digital data R, G and B received from the timing controller 40 to analog pixel signals using gamma voltages from the gamma voltage supplier 38 to apply the pixel signals to the data lines D1 to Dm.

To this end, the data driver 34 includes, for example, a plurality of 8-bit data driver integrated circuits (IC's) 33. The 8-bit data driver IC 33 expresses 64 gray levels using, for example, 6-bit data supplied from the timing controller 40. Specifically, the 8-bit data drive IC 33 generates video signals such that a picture having 64 gray levels can be displayed to correspond to the 6-bit data supplied from the timing controller 40.

This will be described in detail with reference to the following table:

TABLE 1

| 6-Bit Input Data | 8-Bit Drive IC | Expressed Gray Level |
|---|---|---|
| 000000 | 000000XX(00) | 0 Gray Level |
| | 000000XX(01) | |
| | 000000XX(10) | |
| | 000000XX(11) | |
| 000001 | 000001XX(00) | 1 Gray Level |
| | 000001XX(01) | |
| | 000001XX(10) | |
| | 000001XX(11) | |
| 000010 | 000010XX(00) | 2 Gray Level |
| | 000010XX(01) | |
| | 000010XX(10) | |
| | 000010XX(11) | |
| 000100 | . | . |
| 001000 | . | . |
| 010000 | . | . |
| 100000 | | |
| 111111 | 111111XX(00) | 63 Gray Level |
| | 111111XX(01) | |
| | 111111XX(10) | |
| | 111111XX(11) | |

In Table 1, 6-bit data is received from the timing controller 40. The 6-bit data received from the timing controller 40 includes six most significant bits. Additionally, the 8-bit data-driver IC 33 receives specific bits as two least significant bits. The specific bits input as the two least significant bits always have the same value (e.g., "00" or "11") and may be preset by an operator.

Gray levels expressed by the 8-bit data driver IC 33 are determined based upon the 6-bit data input from the timing controller 40. In other words, because the two least significant bits are fixed to have the same value, 4 data signals in which each data signal has a total of 8 bits and the same 6 most significant bits (e.g., 000000XX) would have the same gray levels as can be seen from Table 1. Accordingly, the driving apparatus of the present invention can express $2^n$, for example, 64 gray levels using the 8-bit data driver IC 33 even when 6 bits are received from the exterior thereof, thereby assuring compatibility of the integrated circuit. In other words, the present driving apparatus interprets data having four gray levels to be the same gray level, thereby driving 6-bit ($2^4$=64) data using a 8-bit ($2^8$=256) data driver and hence expressing gray levels of data input as 6-bit using the 8-bit data driver IC 33.

FIG. 4A to FIG. 4D depict a process of inputting a predetermined bit to two least significant bits of the 8-bit data driver IC 33.

Figure 4A:
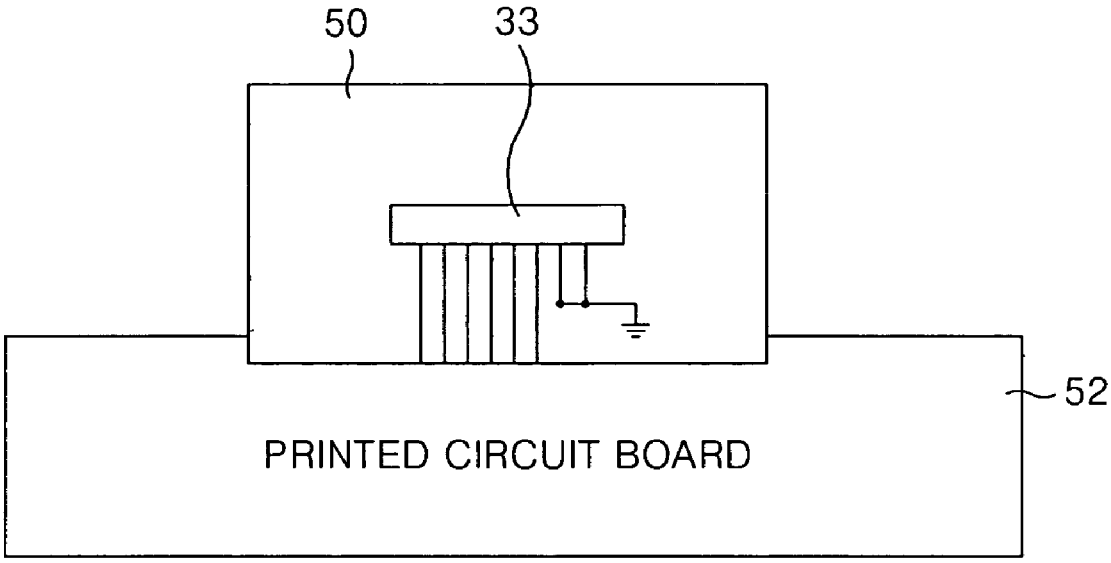
FIG. 4A to FIG. 4D depict an application of predetermined values to two least significant bits.

In FIG. 4A, the data driver IC 33 is mounted in a tape carrier package (TCP) 50 to be connected to a printed circuit board 52 and the liquid crystal display panel 32. In FIG. 4A, a ground voltage source GND may be coupled with two least significant bits of the data driver IC 33. The data driver IC 33 recognizes that "00" of the voltage source GND is input to the two least significant bits. If "00" is input to the two least significant bits, then a data value of "00" is input to all the two least significant bits as can be seen from the Table 2:

TABLE 2

| 6-Bit Input Data | 8-Bit Drive IC | Expressed Gray Level |
|---|---|---|
| 000000 | 00000000 | 0 Gray Level |
| | 00000000 | |
| | 00000000 | |
| | 00000000 | |
| 000001 | 00000100 | 1 Gray Level |
| | 00000100 | |
| | 00000100 | |
| | 00000100 | |
| 000010 | 00001000 | 2 Gray Level |
| | 00001000 | |
| | 00001000 | |
| | 00001000 | |
| . | . | . |
| . | . | . |
| . | . | . |
| 111111 | 11111100 | 63 Gray Level |
| | 11111100 | |
| | 11111100 | |
| | 11111100 | |

More specifically, if a signal of "00" is input to the two least significant bits, then the gray levels of the 8-bit data driver IC 33 are determined based upon 6-bit input data as can be seen from the above Table 2, thereby displaying a picture having 64 gray levels. When "00" is input to the two least significant bits, a slightly darker picture can be displayed. In other words, inputting "00" to the two least significant bits has an effect of emphasizing a darker field in comparison with inputting other bit values (e.g., "01", "10" and "11") to the two least significant bits of the driver IC 33. In other words, each 8-bit data driver IC 33 receives the 6-bits data supplied from the timing controller 40 through six most significant bits input terminals and the specific 2-bits (00) through two least significant bits input terminals. Each 8-bit data driver IC 33 selects 6-bits ($2^6$=64) 64 gray levels (0, 4, 8, 12 . . . 252 (gray level)) corresponding to the 6-bits data supplied from the timing controller 40 from the 8-bits ($2^8$=256) gray levels and outputs the selected 64 gray levels to data lines.

Figure 4B:
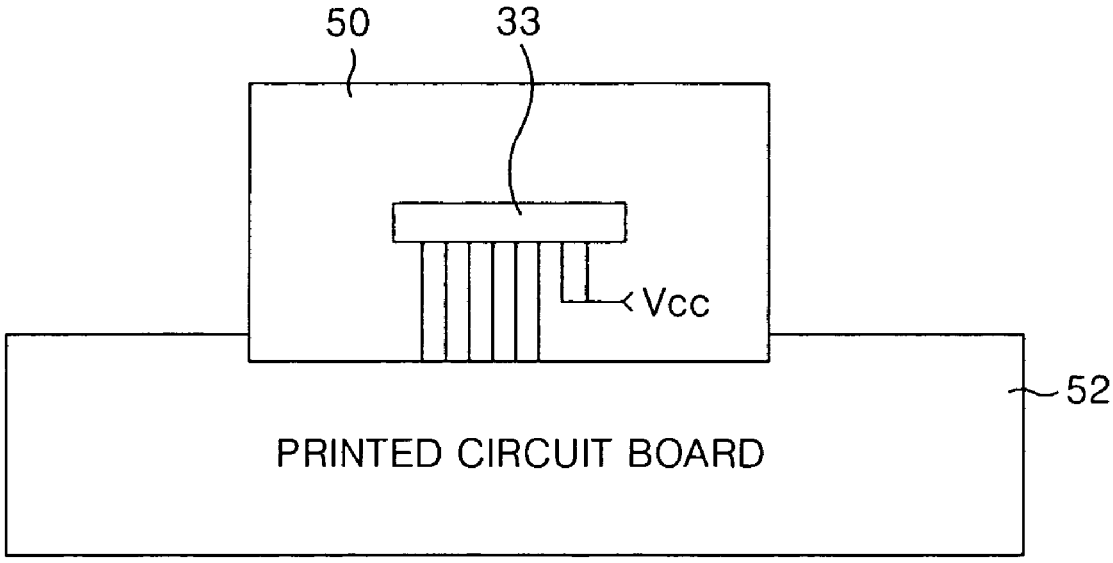

In FIG. 4B, a predetermined voltage Vcc may be supplied to the two least significant bits of the data driver IC 33. At this time, the data driver IC 33 recognizes that "11" is input to the two least significant bits. When "11" is input to the two least significant bits, then a data value of "11" is input to all the two least significant bits as can be seen from the following Table 3:

TABLE 3

| 6-Bit Input Data | 8-Bit Drive IC | Expressed Gray Level |
|---|---|---|
| 000000 | 00000011 | 0 Gray Level |
| | 00000011 | |
| | 00000011 | |
| | 00000011 | |
| 000001 | 00000111 | 1 Gray Level |
| | 00000111 | |
| | 00000111 | |
| | 00000111 | |
| 000010 | 00001011 | 2 Gray Level |
| | 00001011 | |
| | 00001011 | |
| | 00001011 | |
| . | . | . |
| . | . | . |
| . | . | . |
| 111111 | 11111111 | 63 Gray Level |
| | 11111111 | |
| | 11111111 | |
| | 11111111 | |

As shown in Table 3, if a signal of "11" is input to the two least significant bits, then gray levels of the 8-bit data driver IC 33 may be determined based upon 6-bit input data, thereby displaying a picture having 64 gray levels. When "11" is input to the two least significant bits, a slightly brighter picture can be displayed. In other words, inputting "11" to the two least significant bits can display a brighter field in comparison with inputting other bit values (e.g., "00", "01" and "10") to the two least significant bits. In other words, each 8-bit data driver IC 33 receives the 6-bits data supplied from the timing controller 40 through the six most significant bits input terminals and the specific 2-bits (11) through the two least significant bits input terminals. Each 8-bit data driver IC 33 selects 6-bits ($2^6$=64) 64 gray levels (3, 7, 11, 15 . . . 255 (gray level)) corresponding to the 6-bits data supplied from the timing controller 40 from the 8-bits ($2^8$=256) gray levels and outputs the selected 64 gray levels to data lines.

As a result, in the driving apparatus of the present invention, a value of "00" or "11" may be input to the two least significant bits of the IC 33 to display a darker picture or a brighter picture, respectively.

Figure 4C:
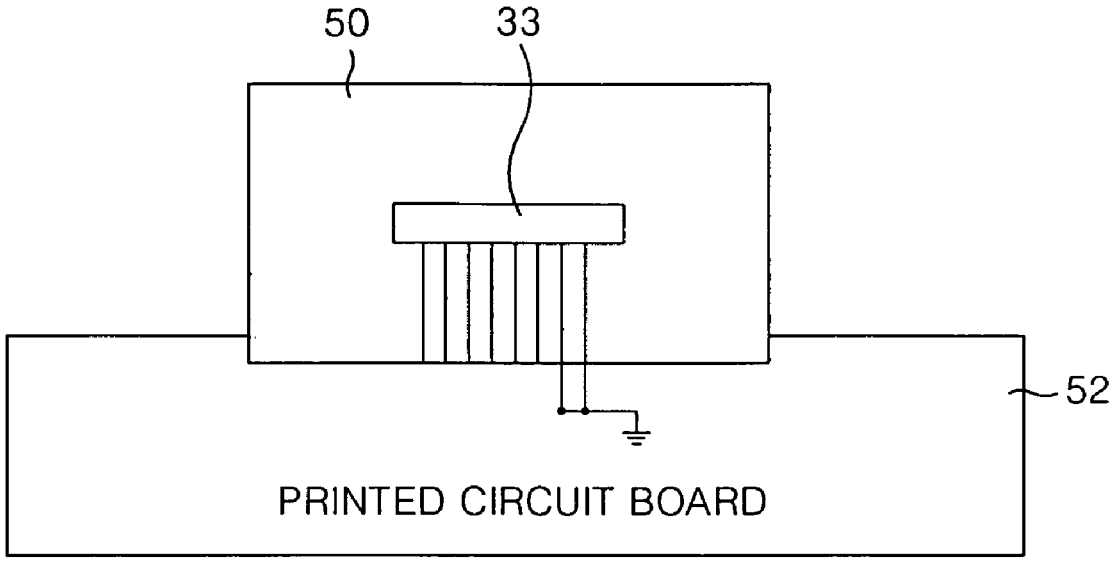
Figure 4D:
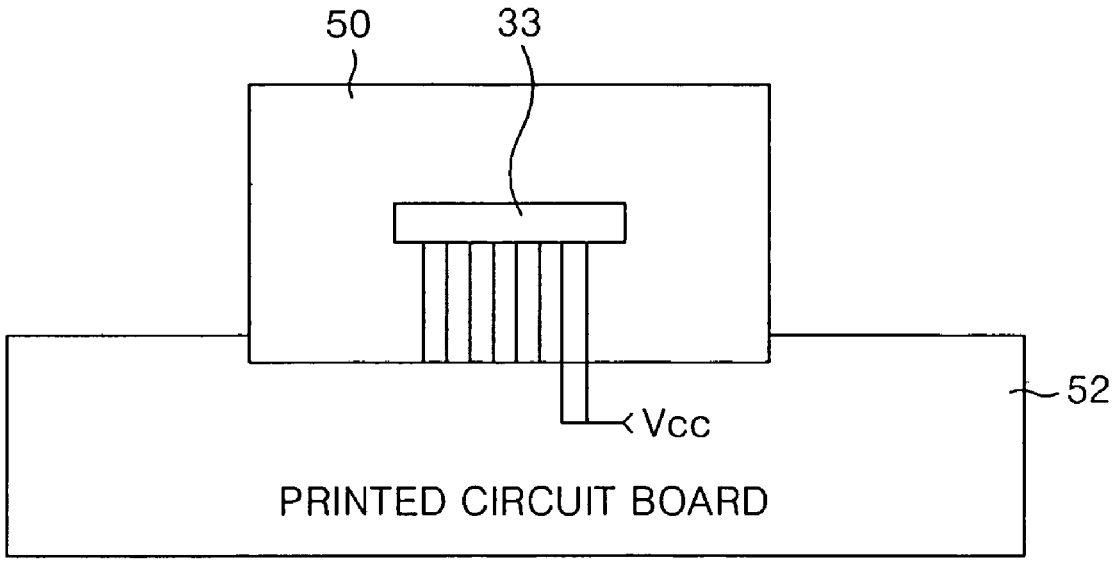

The "00" or "11" value can be input in various ways. For example, in FIG. 4A and FIG. 4B, a ground voltage GND or a predetermined voltage Vcc may input the value from the tape carrier package (TCP) 50. Alternatively, a ground voltage GND or a predetermined Vcc may input the values from the printed circuit board 52 mounted with the timing controller 40 to the two least significant bits as shown in FIG. 4C and FIG. 4D.

Figure 5:
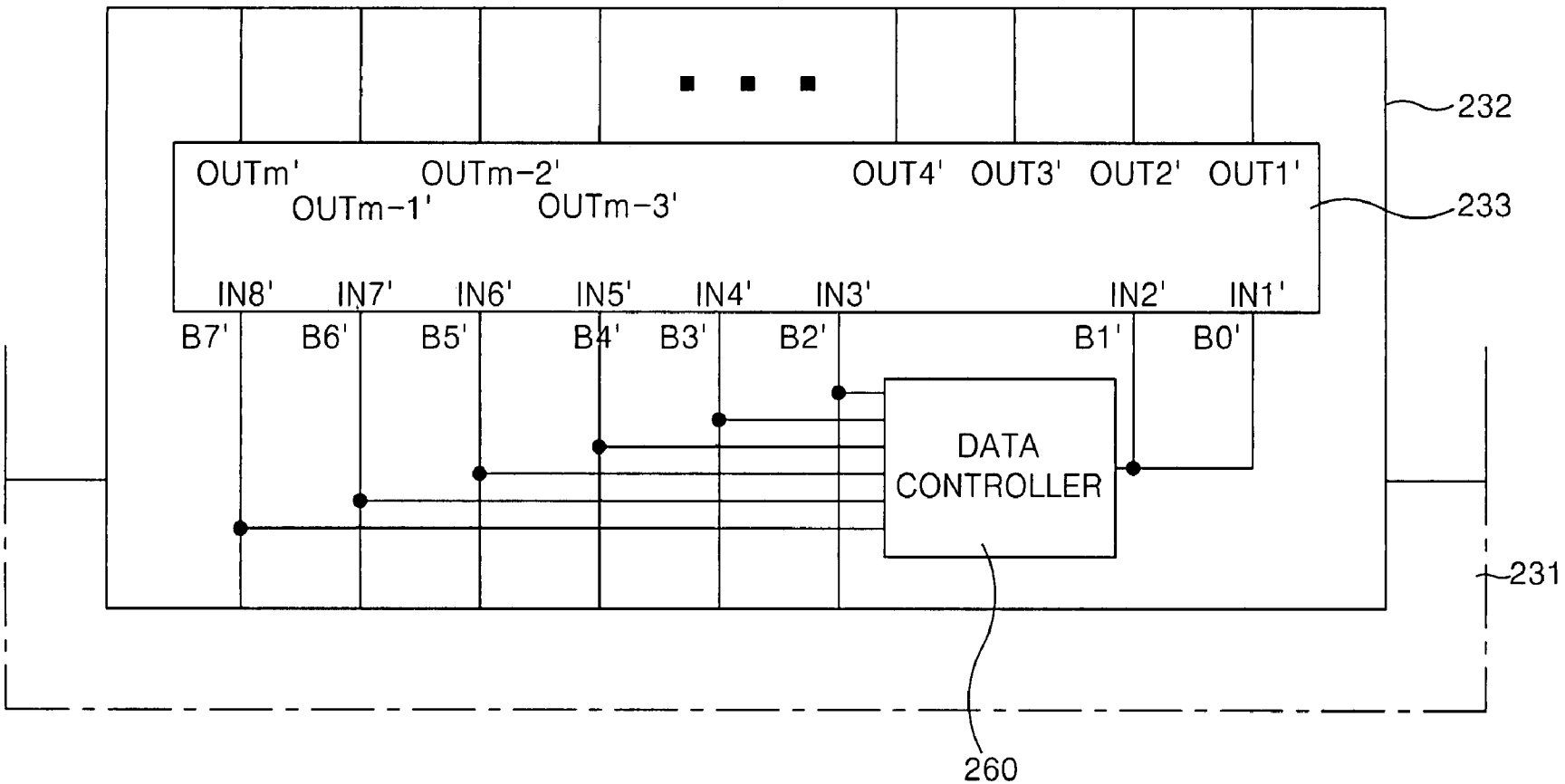
FIG. 5 is a schematic showing a configuration of a driving apparatus for a liquid crystal display according to a second embodiment of the present invention.
Figure 8A:
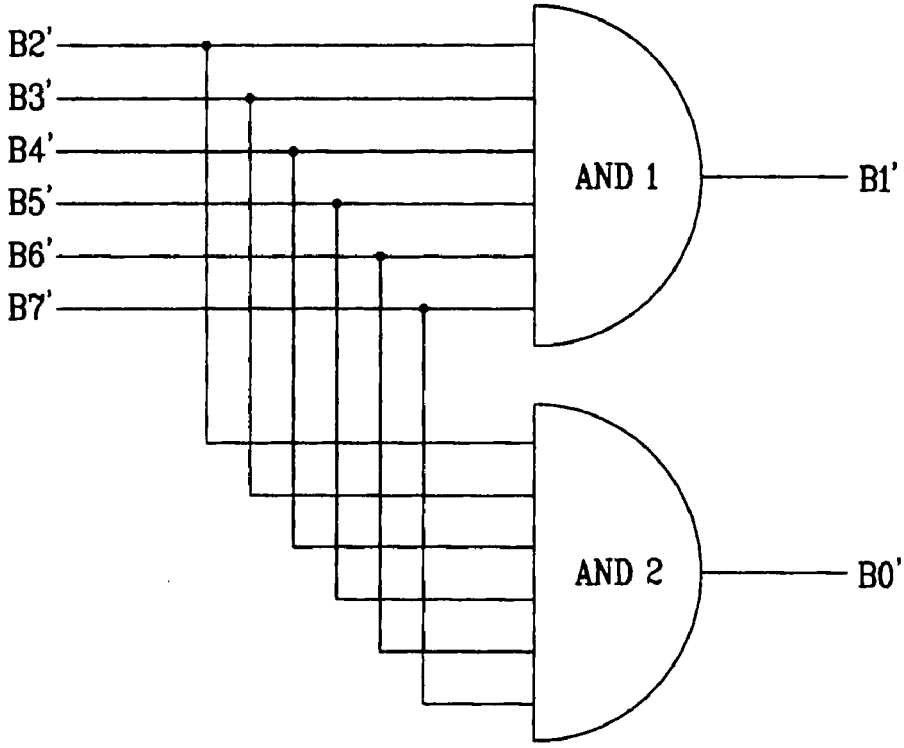
FIG. 8A is a logic circuit of the data controller shown in FIG. 5 in accordance with the first embodiment of the present invention.
Figure 8B:
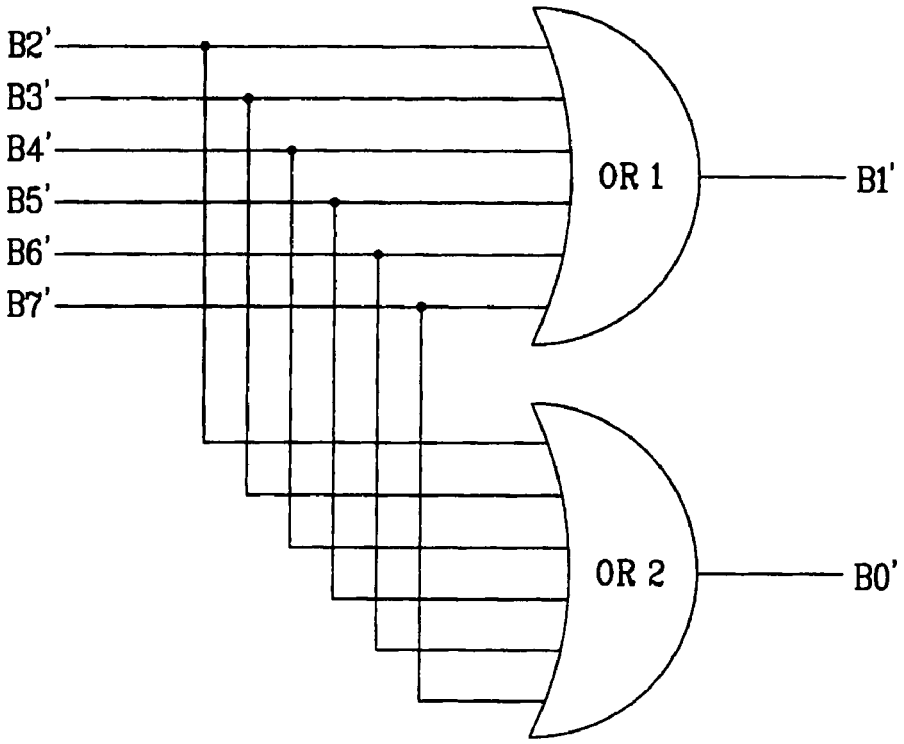
FIG. 8B is a logic circuit of the data controller shown in FIG. 5 in accordance with the second embodiment of the present invention.

FIG. 5 illustrates a driving apparatus for a liquid crystal display (LCD) according to a second embodiment of the present invention. FIG. 8A is a logic circuit of the data controller shown in FIG. 5 in accordance with the first embodiment of the present invention. FIG. 8B is a logic circuit of the data controller shown in FIG. 5 in accordance with the second embodiment of the present invention.

In FIG. 5, the driving apparatus for the LCD includes a data tape carrier package 232 electrically connected to a liquid crystal display panel, a data printed circuit board 231 having a timing controller for 6-bit picture information B2' to B7' provided at the data tape carrier package 232, a data controller 260 for logically combining the 6-bit picture information B2' to B7' to generate 2-bit dummy data B0' and B1', and a 8-bit processing data driver integrated circuit 233 mounted in the data tape carrier package 232 to receive the 6-bit picture information B2' to B7' from the data printed circuit board 231 and the dummy data B0' and B1' from the data controller 260, thereby converting the 2-bit dummy data B0' and B1', along with the picture information B2' to B7', to analog signals that are supplied to data lines of the liquid crystal display panel.

The 2-bit dummy data B0' and B1' input to the data driver integrated circuit 233 are generated from the 6-bit picture information B2' to B7'.

The data driver integrated circuit 233 receives the 2-bit dummy data B0' and B1' generated from the 6-bit information B2' to B7' and the 6-bit information B2' to B7' by, for example, input pins IN1' to IN8'. In other words, the picture information B2' to B7' is 6-bit data. Because the data driver integrated circuit 233 receives the 6-bit picture information B2' to B7' and the 2-bit dummy data B0' and B1', it receives a total of 8-bit data.

The number of output pins, for example, OUT1' to OUTm' of the data driver integrated circuit 233 is differentiated depending on a model or a resolution of the liquid crystal display panel. For example, the number of output channels of the data driver integrated circuit 233 may be any one of 384, 420 and 480.

As shown in FIGS. 8A and 8B, the data controller 260 logically combines the 6-bit picture information B2' to B7' to generate the dummy data B0' and B1', and supplies the dummy data B0' and B1' to the first and second input pins IN1' and IN2' of the data driver integrated circuit 233. The data controller 260 is implemented by for example, AND gates and/or OR gates. If the data controller 260 is implemented by the AND gates, then the 2-bit dummy data B0' and B1' have a logical value of '00' except when the 6-bit picture information B2' to B7' is '111111' as shown in FIG. 6A, thereby emphasizing a low gray level. On the other hand, if the data controller 260 is implemented by the OR gates, then the 2-bit dummy data B0' and B1' have a logical value of '11' except when the 6-bit picture information B2' to B7' is '000000' as shown in FIG. 6B, thereby emphasizing a high gray level.

Alternatively, the data controller 260 may be implemented by a combination of the AND gates with the OR gates to output two dummy data. In this case, the data controller 260 may select any one of the two dummy data to supply to the data driver integrated circuit 233.

The data controller 260 may be provided in the data tape carrier package or provided on the data printed circuit board 231.

Figure 7:
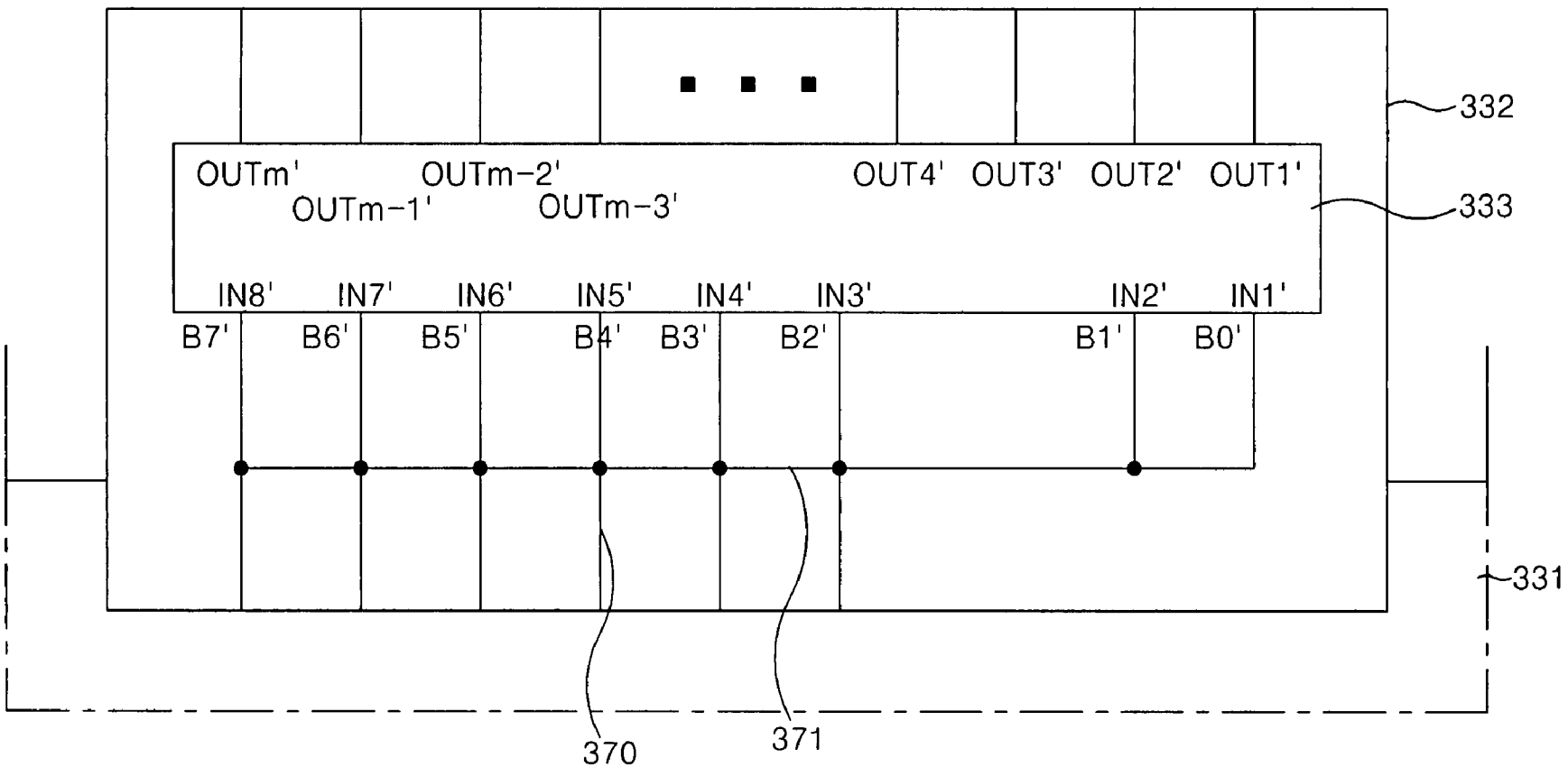
FIG. 7 is a schematic view showing a configuration of a driving apparatus for a liquid crystal display according to a third embodiment of the present application.

FIG. 7 shows a driving apparatus for a liquid crystal display (LCD) according to a third embodiment of the present invention.

In FIG. 7, the driving apparatus for the LCD includes a data printed circuit board 331 for receiving 6-bit picture information B2' to B7', a data tape carrier package 332 electrically connected to the data printed circuit board 331, and a data driver integrated circuit 333 mounted in the data tape carrier package 332 to receive the 6-bit picture information B2' to B7' from the data printed circuit board 231 and dummy data B0' and B1' generated from the data tape carrier package 332.

The data tape carrier package 332 is provided with a first data input line 370 supplied with the 6-bit picture information B2' to B7', and a second data input line 371 connected to at least one of the first data input lines 370. The second data input line 371 is connected to, for example, two input pins IN1' and IN2' provided at the data driver integrated circuit 333.

When the 6-bit picture information B2' to B7' is supplied to the first data input line 370, then the picture information is applied, via the first data input line 370, to third to eighth input pins IN3' to IN8' of the data driver integrated circuit 333, and any one bit thereof is applied, via the second data input line 371, to the first and second input pins IN1' and IN2' of the data driver integrated circuit 333.

Accordingly, the 2-bit dummy data B0' and B1' is identical to any one bit of the 6-bit picture information B2' to B7'. For example, if the second data input line 371 is connected to the most significant bit of the first data input line 370, then the dummy data value is identical to the most significant bit value of the 6-bit picture information B2' to B7'. On the other hand, if the second data input line 371 is connected to the least significant bit of the first data input line 370, then the dummy data value is identical to the least significant bit value of the 6-bit picture information B2' to B7'.

As described above, the driving apparatus according to the present invention receives 6-bit data input from the exterior thereof into six most significant bits and fixes two least significant bits as a predetermined value, thereby supplying video signals that correspond to the 6-bit data using the 8-bit data driver integrated circuit. In other words, the driving apparatus, for use in, for example, a liquid crystal display (LCD) according to the present invention can freely express an 8-bit or 6-bit picture using only the 8-bit data driver integrated circuit.

It will be apparent to those skilled in the art that various modifications and variation can be made in the present invention without departing from the spirit or scope of the invention. Thus, it is intended that the present invention cover the modifications of this invention provided they come within the scope of the appended claims and their equivalents.

What is claimed is:

1. A driving apparatus for a liquid crystal display, comprising:

a display panel having a plurality of gate lines and a plurality of data lines crossing the gate lines;

a data driving circuit for driving the data lines;

a timing controller for supplying n-bit picture information (wherein n is an integer) to the data driving circuit;

a data controller for logically combining the picture information to generate dummy data and for supplying the dummy data to the data driving circuit;

a plurality of tape carrier packages capable of being electrically connected to the display panel and mounted with the data driving circuit, wherein m input channels (wherein m is an integer larger than n) are used to supply the picture information and dummy data to the data driving circuit, wherein the data driving circuit includes a plurality of m-bit data driver integrated circuits, each m-bit data driver integrated circuit receiving the n-bit picture information through n most significant bits input terminals and the dummy data through two least significant bits input terminals and outputting ($2^n$) gray levels using the (n+2) bits associated with the ($2^{n+2}$) gray levels to the data lines, wherein m−2 is n; and at least one AND gate receiving as input the n-bit picture information and outputting the dummy data to the two least significant bits input terminals of the each m-bit data driver integrated circuit, wherein dummy data is data corresponding to the least two significant bits added to the n-bit picture information generated through the use of the AND gate to be compatible with the m-bit data driver integrated circuit.

2. The driving apparatus as claimed in claim 1, wherein the value of n is 6, and the value of m is 8.

3. The driving apparatus as claimed in claim 1, wherein the data controller generates the dummy data using at least one logical operation of a logical sum and a logical product of the n-bit picture information.

4. The driving apparatus as claimed in claim 1, further comprising:

a printed circuit board provided with the timing controller, wherein said data controller is provided on the printed circuit board.

5. The driving apparatus as claimed in claim 1, wherein the data controller is provided in the tape carrier package.

6. A driving apparatus for a liquid crystal display, comprising:

a display panel having a plurality of gate lines and a plurality of data lines crossing the gate lines;

a data driving circuit for driving the data lines;

a timing controller for supplying n-bit picture information (wherein n is an integer) to the data driving circuit;

a data controller for logically combining the picture information to generate dummy data and for supplying the dummy data to the data driving circuit;

a plurality of tape carrier packages capable of being electrically connected to the display panel and mounted with the data driving circuit, wherein m input channels (wherein m is an integer larger than n) are used to supply the picture information and dummy data to the data driving circuit, wherein the data driving circuit includes a plurality of m-bit data driver integrated circuits, each m-bit data driver integrated circuit receiving the n-bit picture information through n most significant bits input terminals and the dummy data through two least significant bits input terminals and outputting ($2^n$) gray levels using the (n+2) bits associated with the ($2^{n+2}$) gray levels to the data lines, wherein m−2 is n; and at least one OR gate receiving as input the n-bit picture information and outputting the dummy data to the two least significant bits input terminals of the each m-bit data driver integrated circuit, wherein dummy data is data corresponding to the least two significant bits added to the n-bit picture information generated through the use of the OR gate to be compatible with the m-bit data driver integrated circuit.

7. The driving apparatus as claimed in claim 6, wherein the value of n is 6, and the value of m is 8.

8. The driving apparatus as claimed in claim 6, wherein the data controller generates the dummy data using at least one logical operation of a logical sum and a logical product of the n-bit picture information.

9. The driving apparatus as claimed in claim 6, further comprising:

a printed circuit board provided with the timing controller, wherein said data controller is provided on the printed circuit board.

10. The driving apparatus as claimed in claim 6, wherein the data controller is provided in the tape carrier package.

* * * * *